US008844570B2

(12) United States Patent
Glick

(10) Patent No.: US 8,844,570 B2
(45) Date of Patent: Sep. 30, 2014

(54) GENERATING BINARY STATES USING A MICROFLUIDIC CHANNEL

(75) Inventor: Casey G. Glick, Chico, CA (US)

(73) Assignee: California Institute of Technology, Pasadena, CA (US)

( * ) Notice: Subject to any disclaimer, the term of this patent is extended or adjusted under 35 U.S.C. 154(b) by 439 days.

(21) Appl. No.: 13/019,204

(22) Filed: Feb. 1, 2011

(65) Prior Publication Data

US 2011/0186164 A1 Aug. 4, 2011

Related U.S. Application Data

(60) Provisional application No. 61/300,329, filed on Feb. 1, 2010.

(51) Int. Cl.
*F15B 21/06* (2006.01)
*F15C 1/00* (2006.01)

(52) U.S. Cl.
CPC ..... *F15C 1/00* (2013.01); *Y10S 137/909* (2013.01)
USPC ..... 137/807; 137/804; 137/825; 137/827; 137/909; 251/129.01

(58) Field of Classification Search
USPC ..... 137/807, 804, 825, 826, 827, 13, 87.01, 137/909, 624.11, 624.13–624.15; 251/129.01
See application file for complete search history.

(56) References Cited

U.S. PATENT DOCUMENTS

| | | | | |
|---|---|---|---|---|
| 6,823,895 | B2 * | 11/2004 | Gordaninejad et al. | 137/827 |
| 6,949,176 | B2 * | 9/2005 | Vacca et al. | 204/547 |
| 7,007,972 | B1 * | 3/2006 | Radhakrishnan et al. | 280/736 |
| 2004/0118646 | A1 * | 6/2004 | Lun | 188/267 |
| 2009/0235990 | A1 * | 9/2009 | Beer | 137/3 |

OTHER PUBLICATIONS

Wen, Weijia; Program & Abstracts the 9th Asian-Pacific International Symposium on Microscale Separations and Analysis (APCE 2009) & The 1st Asian-Pacific International Symposium on Lab-on-Chip (APLOC 2009), Oct. 28-31, 2009.*
Niu, X., et al., Electrorheological-fluid-based microvalves, Applied Physics Letters 2005, 87: 243501-1-243501-3.
Niu, X., et al., Active microfluidic mixer chip, Applied Physics Letters 2006, 88: 153508-1-153508-3.
Liu, L., et al., Microhealers fabricated from a conducting composite, Applied Physics Letters 2006, 223521-1-223521-3.
Niu, X., et al., Real-time detection, control, and sorting of microfluidic droplets, Biomicrofluidics 2007, 1: 044101-1-044101-12.
Whitesides, G., The origins and the future of microfluidics, Nature 2006, 442: 368-373.
Quake, S., et al., From micro- to nanofabrication with soft materials, Science 2000, 290: 1536-1540.
Huebner, et al., Microdroplets: a sea of applications?, Lab on a Chip 2008, 8: 1244-1254.

(Continued)

*Primary Examiner* — Eric Keasel
*Assistant Examiner* — Minh Le
(74) *Attorney, Agent, or Firm* — Steinfl & Bruno LLP

(57) ABSTRACT

Methods and devices for using one or more fluidic channels for generating binary states are described. In particular, the present teachings relate to incorporating such fluidic channels into devices that use the generated binary states in various applications.

41 Claims, 15 Drawing Sheets

(56) References Cited

OTHER PUBLICATIONS

Fair, R., et al., Chemical and biological applications of digital-microfluidic devices, IEEE Des. Test Compu. 2007, 24: 10-24.
Cheow, L., et al., Droplet based logic gates, Appl. Phys. Lett. 2007, 90: 054107-1-054107-3.
Prakash, M., et al., Microfluidic bubble logic, Science 2007, 315: 832-835.
Wen, W., et al., The giant electrorheological effect in suspensions of nanoparticles, Nature Materials 2003, 2: 727-730.
Wen, W., et al., Generation and manipulation of "smart" droplets, Soft Materials 2009, 5: 576-581.
Zhang, M., et al., Manipulations of microfluidic droplets using electrorheological carrier fluid, Physical Rev. E 2008, 78: 066305-1-066305-5.
Niu, X., et al., Characterizing and patterning of PDMS-based conducting composites, Adv. Materials 2007, 19: 2682-2686.
Wen, W., et al., Electrorheological fluids: structures and mechanisms, Soft Matter 2008, 4: 200-210.
deMello, A., et al., Chemistry at the crossroads, Nature Chemistry 2009, 1: 28-29.
Wang, L., et al., Logic control of microfluidics with smart colloid, Lab on a Chip 2010, 10: 2869-2874.
Zhang, J., et al. Electrorheological fluid dynamics, Physical Review Letters 2008, 194503-1-194503-4.

* cited by examiner

| Droplet in control channel 110 | $V_G$ Across GER | $V_G(V)$ | GER Rheology | GER State in GER channel 105 | Output Flow from GER channel 105 | Output Signal |
|---|---|---|---|---|---|---|
| No Droplet | Low $V_G$ | $V_G(0) = \frac{1}{31}$ V | Liquid | "Off" | "On" | GER Flow |
| Droplet | High $V_G$ | $V_G(1) = \frac{4}{7}$ V | Anisotropic Solid | "On" | "Off" | GER Blocked |

FIG. 5

| | | Channel 5 $C_3(x)$ | |
|---|---|---|---|
| | | 0 | 1 |
| Channel 6 $C_4(y)$ | 0 | $\frac{1}{91}(-V1 - 30V2 + 30V3 + V4)$ | $\frac{1}{520}(-7V1 - 210V2 + 93V3 + 124V4)$ |
| | 1 | $\frac{1}{520}(-124V1 - 93V2 + 210V3 + 7V4)$ | $\frac{1}{13}(-4V1 - 3V2 + 3V3 + 4V4)$ |

FIG. 12

| INPUT | | Input polarities | | | | | A | 0 | 0 | 1 | 1 | |
|---|---|---|---|---|---|---|---|---|---|---|---|---|
| | | V1 | V2 | V3 | V4 | | B | 0 | 1 | 0 | 1 | |
| OUTPUT | FALSE | | | | | | FALSE | 0 | 0 | 0 | 0 | ← 25 |
| | A AND B | + | | | - | | A AND B | 0 | 0 | 0 | 1 | ← 26 |
| | A?>B | + | - | - | 0 | | A?>B | 0 | 0 | 1 | 0 | ← 27 |
| | A | + | | - | | | A | 0 | 0 | 1 | 1 | ← 28 |
| | A<? B | 0 | - | - | + | | A<? B | 0 | 1 | 0 | 0 | ← 29 |
| | B | | + | | - | | B | 0 | 1 | 0 | 1 | ← 30 |
| | A XOR B | ++ | - | - | ++ | | A XOR B | 0 | 1 | 1 | 0 | ← 31 |
| | A OR B | ++ | 0 | 0 | – | | A OR B | 0 | 1 | 1 | 1 | ← 32 |
| | A NOR B | 0 | - | + | 0 | | A NOR B | 1 | 0 | 0 | 0 | ← 33 |
| | A XNOR B | -- | + | - | ++ | | A XNOR B | 1 | 0 | 0 | 1 | ← 34 |
| | NOT B | | + | - | + | | NOT B | 1 | 0 | 1 | 0 | ← 35 |
| | A <= B | -- | - | + | 0 | | A <= B | 1 | 0 | 1 | 1 | ← 36 |
| | NOT A | + | - | + | | | NOT A | 1 | 1 | 0 | 0 | ← 37 |
| | A => B | 0 | + | - | -- | | A => B | 1 | 1 | 0 | 1 | ← 38 |
| | A NAND B | - | + | - | + | | A NAND B | 1 | 1 | 1 | 0 | ← 39 |
| | TRUE | | + | - | | | TRUE | 1 | 1 | 1 | 1 | ← 40 |

↑ 21 ↑ 22 ↑ 23 ↑ 24

FIG. 13

| A | 0 | 0 | 1 | 1 | Meaning of Logical Operation | |
|---|---|---|---|---|---|---|
| B | 0 | 1 | 0 | 1 | | |
| FALSE | 0 | 0 | 0 | 0 | Output is false for all input | ← 25 |
| A AND B | 0 | 0 | 0 | 1 | Output is true iff A and B are true | ← 26 |
| A?>B | 0 | 0 | 1 | 0 | B is not implied by A: true iff A but not B | ← 27 |
| A | 0 | 0 | 1 | 1 | True if A is true | ← 28 |
| A<? B | 0 | 1 | 0 | 0 | A is not implied by B. True iff B but not A | ← 29 |
| B | 0 | 1 | 0 | 1 | True if B is true | ← 30 |
| A XOR B | 0 | 1 | 1 | 0 | True iff A is not equal to B | ← 31 |
| A OR B | 0 | 1 | 1 | 1 | True if either A or B is true (non-exclusive) | ← 32 |
| A NOR B | 1 | 0 | 0 | 0 | True iff neither A nor B | ← 33 |
| A XNOR B | 1 | 0 | 0 | 1 | True if A is equal to B | ← 34 |
| NOT B | 1 | 0 | 1 | 0 | True if B is false | ← 35 |
| A <= B | 1 | 0 | 1 | 1 | B implies A. False iff B but not A | ← 36 |
| NOT A | 1 | 1 | 0 | 0 | True if A is false | ← 37 |
| A => B | 1 | 1 | 0 | 1 | A implies B. False iff A but not B | ← 38 |
| A NAND B | 1 | 1 | 1 | 0 | False iff A and B are both true | ← 39 |
| TRUE | 1 | 1 | 1 | 1 | Output is true for all input | ← 40 |

↑ 23 ↑ 24

FIG. 14

GENERATING BINARY STATES USING A MICROFLUIDIC CHANNEL

CROSS REFERENCE TO RELATED APPLICATIONS

This application claims priority under 35 U.S.C. §119(e) from U.S. Provisional Patent Application No. 61/300,329 entitled "Universal Microfluidic Logic Gate" filed on Feb. 1, 2010, which is incorporated herein by reference in its entirety.

FIELD

The present teachings relate to using one or more microfluidic channels for generating binary states. In particular, the present teachings relate to incorporating such microfluidic channels into devices that use the binary states in various applications.

DESCRIPTION OF RELATED ART

Controlling the flow of fluids in microfluidic channels presents many challenges, especially when the fluids have low Reynolds numbers and the control is implemented upon continuous flowing liquids. One of the challenges lies in the difficulty of scaling down conventional flow control mechanisms such as valves, pumps, switches and mixers for use in controlling fluid flow inside microfluidic channels.

In one prior art solution, in addition to a first network of fluid-carrying channels, a separate network of channels is used to transport compressed air for use in operating valves and pumps. Understandably, such a separate network of channels not only involves additional internal structures inside a device in which the fluid-carrying channels are located, but also necessitates the use of additional structures external to the device. Such external structures may include transport structures for transporting the compressed air; interface structures for coupling the compressed air into the device; and control mechanisms for selectively modifying the air flow for activating control elements such as valves and pumps. The control mechanisms not only tend to be complex and bulky but also provide a less than desired level of accuracy in controlling fluid flow inside the fluid-carrying channels.

In an alternative approach, rather than using continuous flow techniques, a droplet-based approach is used wherein nanoliter to picoliter sized droplets of a fluid are introduced into a microfluidic channel, either individually or as a mixture along with one or more other fluids. One shortcoming associated with this alternative approach is that it is difficult to detect and control individual droplets for ensuring that a correct amount of fluid is being introduced into the microfluidic channel, even when external timers are used for controlling the introduction of the droplets into the microfluidic channel. Another shortcoming may be encountered when the droplet is in the form of a gas bubble, for example. In this case, the gas bubble may tend to disperse, escape, or dissolve, thereby rendering the delivery of the gas bubble through the microfluidic channel an uncertain and imprecise process. Additionally, a gas bubble is limited in its ability to transport usable materials, like chemicals or proteins, within a microfluidic device.

It is accordingly desirable to provide an arrangement that not only provides for precise fluid control, but also permits two fluids to be transported separately without intermixing, while accommodating flow control techniques and the generation of information in the form of digital data.

SUMMARY

According to a first aspect of the present disclosure, a fluidic device for generating binary states is provided. The device includes a first fluidic channel; and an electrode system that is arranged to provide a voltage potential that traverses at least a portion of the first fluidic channel. The device also includes a first fluid delivery system for introducing into the at least a portion of the first fluidic channel, a first fluid at a first instant in time and a second fluid at a second instant in time, wherein the first and the second instants in time correspond to a first binary state and a second binary state characterized by a first voltage differential and a second voltage differential respectively across the at least a portion of the first fluidic channel as a result of the first and second fluids being present in the at least a portion of the first fluidic channel at the first and the second instants in time.

According to a second aspect of the present disclosure, a method of generating binary states is provided. The method includes a first step of applying a voltage potential that traverses at least a portion of a first fluidic channel; and further includes a second step of positioning one of a first fluid or a second fluid inside the at least a portion of the first fluidic channel for modifying the voltage potential on the basis of at least one of a first dielectric constant or a first conductivity associated with the first fluid and at least one of a second dielectric constant or a second conductivity associated with the second fluid.

According to a third aspect of the present disclosure, a fluidic system for generating binary states is provided. The fluidic system includes a first fluidic control channel containing a first fluid through which is transported at least a first droplet comprising a second fluid; and further includes an actuator system comprising a toggle element that is settable to one of a first physical condition or a second physical condition upon subjecting the toggle element to a corresponding one of a first voltage potential or a second voltage potential that is generated as a result of the first droplet being located at one of a first position or a second position in the first fluid.

Further aspects of the disclosure are shown in the specification, drawings and claims of the present application.

BRIEF DESCRIPTION OF THE DRAWINGS

Many aspects of the present disclosure can be better understood with reference to the following drawings. The components in the drawings are not necessarily drawn to scale. Instead, emphasis is placed upon clearly illustrating various principles. Moreover, in the drawings, like reference numerals designate corresponding parts throughout the several views.

FIG. 5 shows a first table that provides certain details of the operating states of the embodiment shown in FIG. 2.

FIG. 12 shows a truth table indicating various voltage conditions associated with the equivalent electrical circuit shown in FIG. 11.

FIG. 13 shows a truth table indicating various logic conditions that may be implemented using the universal logic device shown in FIG. 10.

FIG. 14 provides some additional details pertaining to the truth table shown in FIG. 13.

DETAILED DESCRIPTION

Throughout this description, embodiments and variations are described for the purpose of illustrating uses and implementations of the inventive concept. The illustrative description should be understood as presenting examples of the inventive concept, rather than as limiting the scope of the concept as disclosed herein. For example, it will be understood that terminology such as, for example, voltage potential, voltage drop, voltage condition, voltage differential, nodes, terminals, circuits, devices, systems, and coupling are used herein as a matter of convenience for description purposes and should not be interpreted literally in a narrowing sense. For example, a voltage potential may be alternatively referred to herein as a voltage differential, or a voltage drop. A person of ordinary skill in the art will understand that these terms may be used interchangeably and as such must be interpreted accordingly. It will be also be understood that the drawings use certain symbols and interconnections that must be interpreted broadly as can be normally understood by persons of ordinary skill in the art. As one example, of such interpretation, the fluidic channels are shown to include channel walls. However, one of ordinary skill in the art will understand that fluidic channels are often created as voids or cavities in other materials and as such do not have a wall but rather may have one or more internal surfaces formed as a result of the void or cavity. Similarly, a capacitor or a dielectric element may be an integral part of a semiconductor layer inside an integrated circuit and formed using semiconductor fabrication techniques, or could be an integrated component of the microfluidic device, for example. It will be further understood that various words herein such as the word "droplet" encompasses various volumes of liquids such as a drop, a cluster of drops, a continuous flow, or an agglomerate; the phrase "fluidic channel" encompasses various sizes, such as a nanofluidic channel, a microfluidic channel and a channel of significantly larger size; the word "NOT" may be used interchangeably with "INVERTER"; and the word "voltage" encompasses voltages of various amplitudes and polarities. Specifically, in various figures the voltage labels indicate "0" V and "V" volts. However, in various embodiments, the voltage labels may be replaced with "−V" and "+V" wherein a proper usage of an appropriate voltage differential is more effective than absolute voltage values.

Figure 1:
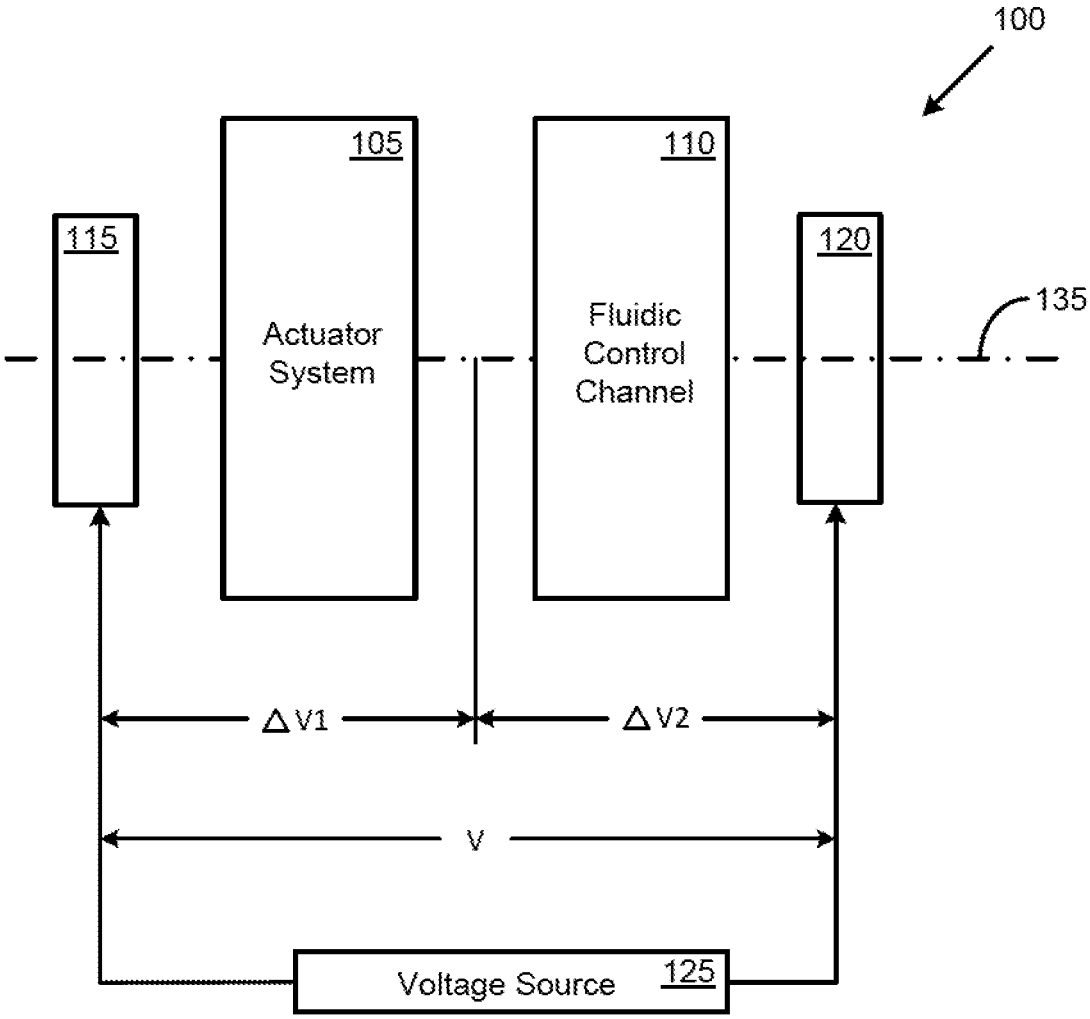
FIG. 1 shows a fluidic system having a fluidic control channel that is used for controlling an actuator system based on fluid flow inside the fluidic control channel.

Attention is now drawn to FIG. 1, which shows a fluidic system 100 having a fluidic control channel 110 that is used for controlling an actuator system 105. Voltage source 125 is used to supply to electrodes 115 and 120, a voltage "V" of a suitable amplitude and polarity. The application of this voltage "V" results in a first voltage drop Δv1 across actuator system 105 and a second voltage drop Δv2 across fluidic control channel 110. Fluidic control channel 110 is configured to generate binary states, in a process that will be described below in further detail using other figures. In a first binary state, the second voltage drop Δv2 takes on a first amplitude, while in a second binary state, the second voltage drop Δv2 takes on a different amplitude. This variation in amplitude in second voltage drop Δv2 results in corresponding changes in the amplitude of first voltage drop Δv1, in order to satisfy the condition V=Δv1+Δv2. The variation in amplitude in first voltage drop Δv1 is used to actuate a toggle element (not shown) associated with actuator system 105. The actuation can then be used to control additional elements (not shown) that may be coupled to actuator system 105.

However, it will be understood that in general, fluidic control channel 110 may be used as a stand-alone element for generating binary states that can be exploited for a variety of uses. Such embodiments may not necessarily include actuator system 105. For example, actuator system 105 may be replaced by a different element that carries out one or more of a measuring, a computing, or an analytical function.

Figure 2:
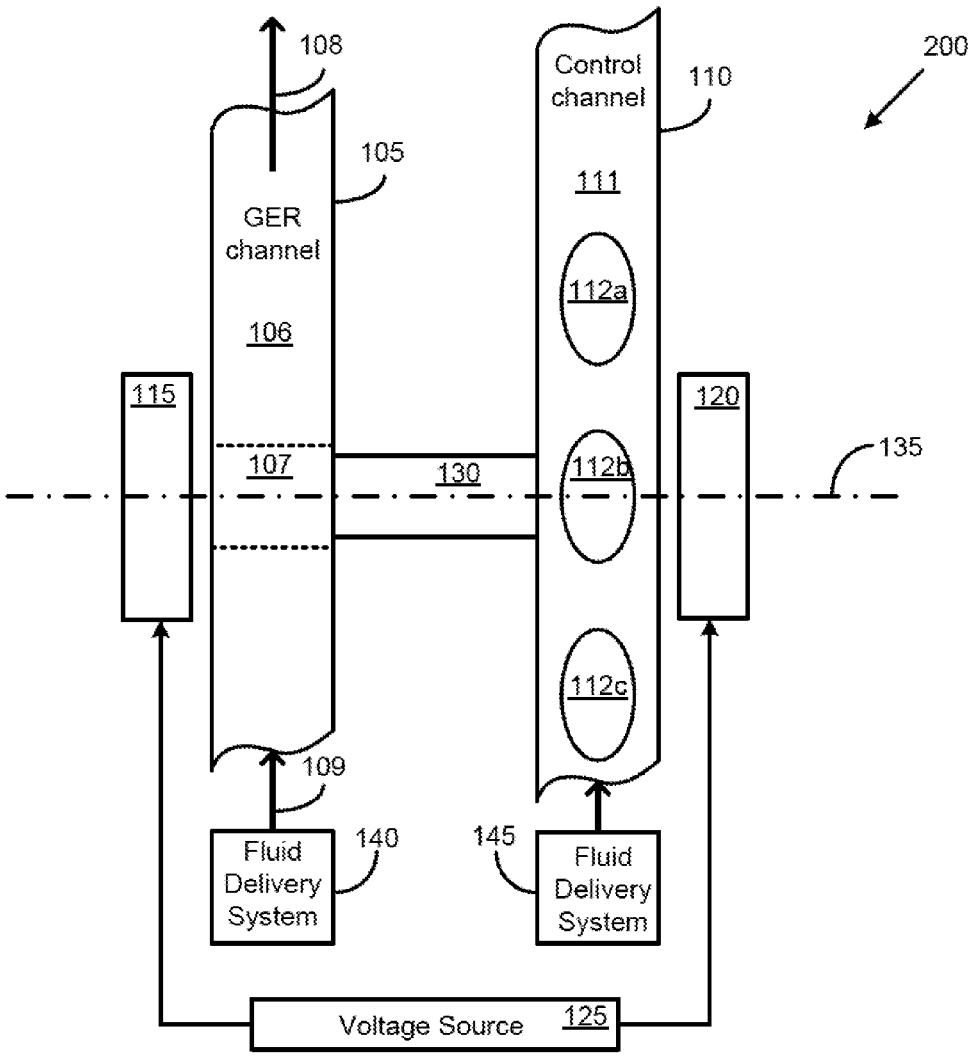
FIG. 2 shows a first embodiment of the fluidic system of FIG. 1, wherein the fluidic control channel controls an actuator system in the form of a fluidic channel with electrorheological fluid inside.

FIG. 2 shows one example embodiment of a fluidic system 200 wherein the binary states generated in microfluidic control channel 110 are used for controlling the flow of an electro-rheological fluid 106 (toggle element) in a second microfluidic channel 105 (actuator system).

Microfluidic control channel 110 contains a first fluid 111 and a second fluid 112, wherein the second fluid 112 is shown herein in the form of droplets 112*a*, 112*b* and 112*c*. The dielectric constant or conductivity associated with the first fluid 111 is typically selected to be different than the dielectric constant or conductivity associated with the second fluid 112. Also, in various applications, the second fluid 112 is selected to be immiscible with the first fluid 111 so as to reduce or eliminate problems such as those associated with dispersion, solubility, and mobility. A few non-limiting examples of first fluid 111 includes fluids such as oil and water, while second fluid 112 includes oil and air (pure water, salt water etc).

One or both of the fluids are introduced into microfluidic control channel 110 by fluid delivery system 145. Fluid delivery system 145 is merely a pictorial representation of various ways by which one or more fluids can be introduced into microfluidic control channel 110. A few non-limiting examples include a real-time delivery system that introduces droplets 112*a*, 112*b*, and 112*c* into microfluidic control channel 110 in a periodic sequence, an intermittent sequence, or a one-time sequence, under control of a control mechanism (not shown). The control mechanism may be a manual control operated by a human being, or may be an electronic control. In certain embodiments, once introduced into microfluidic control channel 110, one or more of droplets 112*a*, 112*b*, and 112*c* may be further restricted to remain within the microfluidic control channel 110 and manipulated from one position to a different position. Various flow-focusing techniques may be used to form droplets 112*a*, 112*b*, and 112*c* inside microfluidic control channel 110.

Also shown in FIG. 2, is an electrode system that includes a first electrode 120 and a second electrode 115. Voltage source 125 provides voltage to the two electrodes whereby a voltage potential is set up along transverse axis 135. Transverse axis 135 is substantially orthogonal to, and traverses microfluidic control channel 110, creating an electromagnetic field between the first electrode 120 and the second electrode 115. It will be understood that in an application wherein microfluidic control channel 110 is a stand-alone element, or is incorporated into a different configuration, first electrode 120 and second electrode 115 may be located immediate adjacent to, and straddling, microfluidic control channel 110 such that the voltage potential traverses microfluidic control channel 110 along transverse axis 135. In effect, the voltage potential is arranged to intersect and be affected by at least one of first fluid 111 and second fluid 112.

To understand this arrangement in further detail, each of control channel 110 and GER channel 105 may be visualized as two capacitors arranged such that the voltage provided by voltage source 125 is applied across the two capacitors as well as any object (separation barrier 130) that may be located between the two capacitors. Each capacitor has certain properties such as a dielectric constant or an electrical conductivity that comes into play when the binary states are generated in microfluidic control channel 110. To elaborate, the properties affect the amplitude of voltage drops across each element ($\Delta v1$ and $\Delta v2$). In the case of microfluidic control channel 110, the dielectric constant (or electrical conductivity) is a variable value that is dependent on the position of second fluid 112 vis-à-vis transverse axis 135. Specifically, when second fluid 112 is located to intersect transverse axis 135, the dielectric value of the capacitor (microfluidic control channel 110) is different from when second fluid 112 is moved away and only first fluid 111, which has a different dielectric constant, is present. The change in dielectric constant/electrical conductivity results in the two different voltage values that $\Delta v2$ can take on. These two different voltage values are interpreted as the binary states, which may be used for various binary applications.

In terms of one such binary application, attention is now drawn to a microfluidic channel 105 arranged to be substantially parallel to microfluidic control channel 110. For the sake of convenience, only a portion of microfluidic channel 105 is shown in FIG. 2. In some applications, this portion may constitute the entire length of the channel, while in other applications, microfluidic channel 105 extends beyond the area shown. In these other areas, microfluidic control channel 110 may no longer run parallel to microfluidic control channel 110, and in certain instances may intersect microfluidic control channel 110, say, for example, on a different layer, above or below a layer in which microfluidic control channel 110 is fabricated. It will also be understood that the parallel arrangement is merely one arrangement and in other arrangements, the relative orientation, dimensions, and separation distances of the two channels may be different as long as the capacitor effect between electrodes 115 and 120 are operative.

In the embodiment shown in FIG. 2, the first electrode 120 is located adjacent to microfluidic control channel 110 and the second electrode 115 is located adjacent to microfluidic channel 105, thereby setting up a voltage potential that traverses both microfluidic channels. The voltage potential further traverses a separation barrier 130 that is provided in order to keep the fluid inside microfluidic control channel 110 from coming in direct or indirect contact (mixing, exposure etc) with a fluid contained inside microfluidic channel 105. Separation barrier 130 may be formed of a variety of materials. In one embodiment, a polymer is used. The polymer may include other substances included, such as, for example, an electrically conductive element. A few non-limiting examples of electrically conductive elements include copper, silver, and gold. One example of a material used in separation barrier 130 is a polydimethylsiloxane (PDMS) compound, more specifically, in one embodiment, a PDMS compound with a silver micropowder additive. This material is referred to as AgPDMS. Another example of a material used in separation barrier 130 is poly(methyl methacrylate) (PMMA).

Various fluids can be transported via microfluidic channel 105 and various applications can be employed in various arrangements. These various applications include analytical applications, wherein the chemical, physical, biological and/or optical parameters of the fluid can be assessed; dispensing applications wherein a measurable quantity of a fluid can be delivered via microfluidic channel 105; and control applications, wherein the fluid contained inside microfluidic channel 105 is used for controlling various elements such as a switch or a valve, for example. Channel 105 can also be a non-fluidic switch mechanism wherein no fluids are used at all.

In this particular example embodiment, as mentioned above, the fluid contained inside microfluidic channel 105 is an electrorheological fluid. Furthermore, in one specific case, the electrorheological fluid is a Giant Electrorheological (GER) fluid. As is known, electrorheological fluids react to appropriate electrical stimuli by changing physical characteristics. In the case of GER, the fluid transforms from a liquid state to a semi-solid or solid state depending upon the amplitude of a voltage potential applied across the GER fluid.

The GER fluid, or other fluid in microfluidic channel 105, referred to hereafter as GER fluid 106, is introduced into microfluidic channel 105 using a fluid delivery system 140. Fluid delivery system 140 is merely a pictorial representation of various ways by which one or more fluids can be introduced into microfluidic channel 105. A few non-limiting examples include a real-time delivery system that introduces the fluid into microfluidic channel 105 in a periodic sequence, an intermittent sequence, or a one-time sequence. The delivery may be controlled using a manual or an automatic control mechanism (not shown). When manual, the fluid is introduced into microfluidic channel 105 by a human being, in certain cases on a one-time basis. In certain embodiments, once introduced into microfluidic channel 105, the fluid may be confined within microfluidic channel 105 in order to carry out a control action, for example. This aspect will be described below in more detail using FIG. 9. In certain other embodiments, the fluid may be allowed to flow out of microfluidic channel 105. In yet other embodiments, the flow of fluid either inside or out of microfluidic channel 105 may be used as a binary indicator, for example, in the implementation of Boolean logic circuits or devices. This aspect will be described below in more detail using several figures.

When the fluid inside microfluidic channel 105 is GER, the GER fluid 106 in area 107 transforms from a liquid state to a semi-solid or solid state depending upon the amplitude of the voltage potential present along transverse axis 135. As explained above, this voltage potential can be set to one of two binary states by suitably positioning second fluid 112 inside microfluidic control channel 110. Specifically, when droplet **112*b* is located as shown (so as to intersect transverse axis 135), the voltage differential across electrodes 115 and 120 rises above a threshold voltage potential, thereby leading to a transformation of GER fluid 106 from a liquid state to a semi-solid or solid state (depending upon the amplitude of the threshold voltage potential). The threshold voltage potential can be suitably selected based on the nature of individual applications. When area 107 is in a liquid state, GER fluid 106 is permitted to flow out of GER channel 105 as indicted by arrow 108. On the other hand, when area 107 is in a solid state, the flow of GER fluid 106 out of GER channel 105** is blocked.

The electrical aspects are described below in further detail using other figures.

Figure 3:
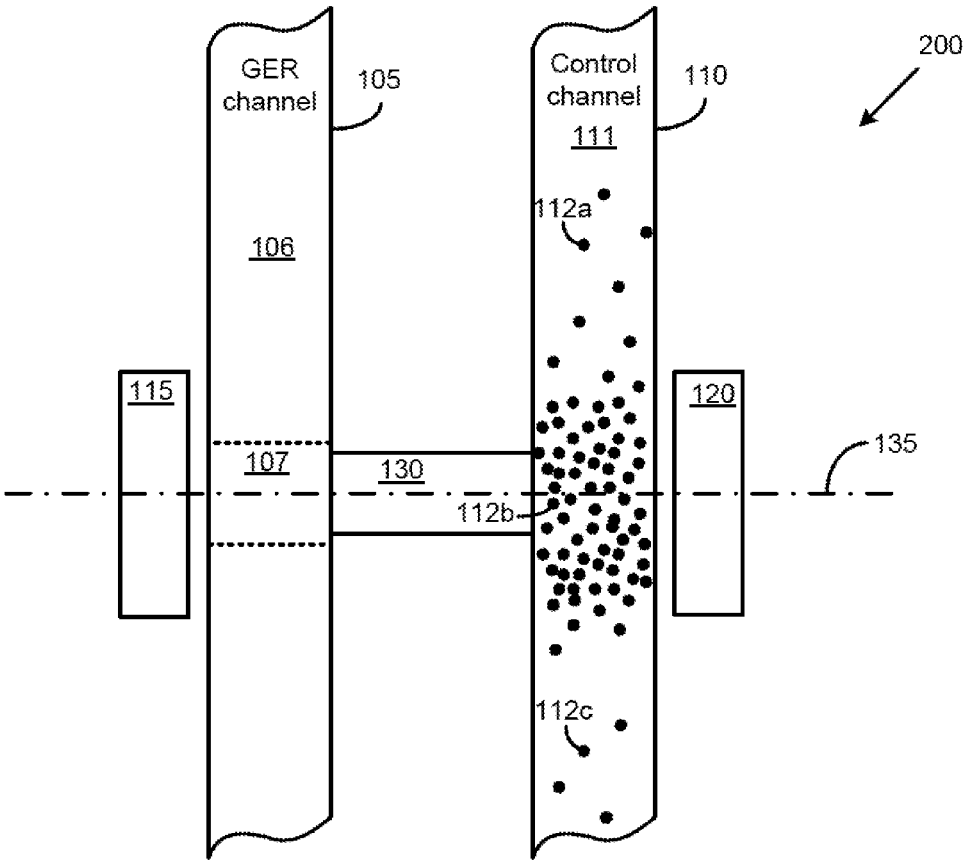
FIG. 3 shows an alternative embodiment of the configuration shown in FIG. 2.

Attention is now drawn to FIG. 3, which shows a variation in the nature of the fluid flow inside microfluidic control channel 110. In the embodiment shown in FIG. 3, second fluid 112 is introduced into microfluidic control channel 110 in a cluster form. Unlike the embodiment shown in FIG. 2, wherein the size of droplets 112*a*, 112*b* and 112*c* are substantially large and are comparable to the diameter of microfluidic control channel 110, each cluster in the embodiment shown in FIG. 3 contains numerous droplets. Whether one droplet, or numerous droplets, the net effect of second fluid 112 being located between electrodes 120 and 115 is the resulting change in voltage differential between electrodes 120 and 115, or in other words, the generation of one of the two binary states. First fluid 111 may be introduced into microfluidic control channel 110 in several different ways. In a first approach, first fluid 111 is introduced into microfluidic control channel 110 at a first instant in time and second fluid 112 is introduced at a later instant in time. The first and second instants can be repeated thereafter, or may be a one-time sequence. In a variation of this first approach, there may be one or more overlapping periods between the first and second instants when both fluids are simultaneously introduced into microfluidic control channel 110. In a different approach, first fluid 111 is introduced into microfluidic control channel 110 in a repetitive first sequence, and a mixture of first fluid 111 and second fluid 112 is introduced into microfluidic control channel 110 in a repetitive second sequence that either overlaps portions of the first sequence or is interspersed with the first sequence. It will be understood that the fluid flow techniques described herein with reference to microfluidic control channel 110 may be applied to microfluidic channel 105 as well.

Figure 4:
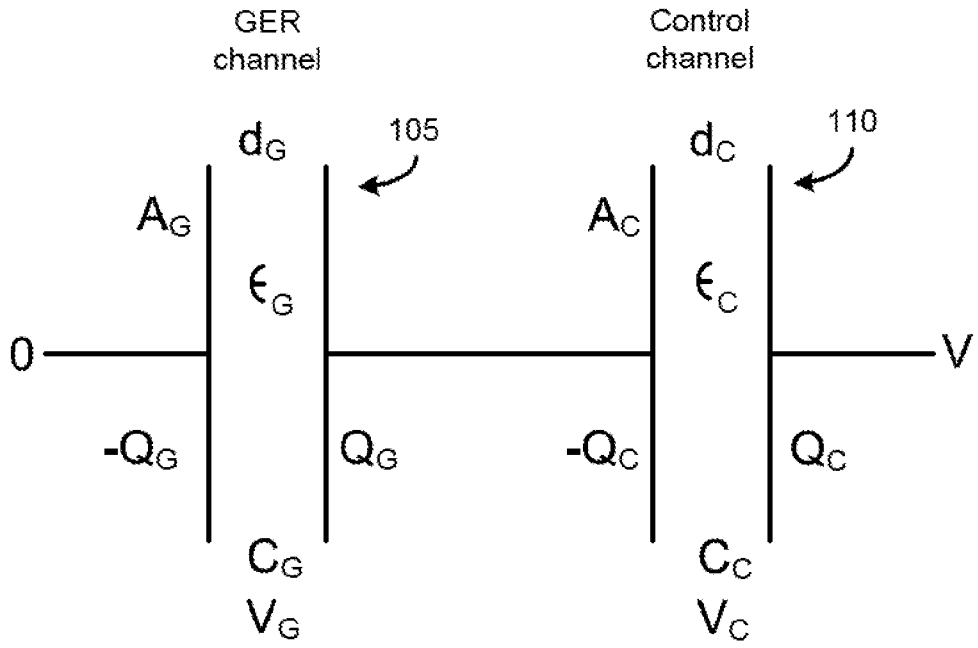
FIG. 4 shows an equivalent electrical circuit of the configuration shown in FIG. 2.

FIG. 4 shows an equivalent electrical circuit representation of microfluidic control channel 110 arranged to interact with microfluidic channel 105. In this particular interpretation, each microfluidic channel is represented as a capacitor, and it is assumed that second fluid 112 has a higher dielectric constant than first fluid 111. The following set of equations is used to derive the amplitudes of the voltage differentials with and without droplet 112*b* affecting the capacitance calculations. These calculations are merely a specific embodiment of the possible calculations, which could also include forms where the voltage to the far left is not grounded and instead some arbitrary V2 is provided. The grounded configuration has been used here merely for simplification of the calculations presented herein for illustrative purposes.

$$C = \frac{Q}{v} = \frac{A\varepsilon}{d}$$

herein C=capacitance in farads; A=area of electrode plates; ∈=permittivity/dielectric constant; and separation distance (t)=d.

$$C_C = \frac{A_C\varepsilon_C}{d_C} \text{ and } C_G = \frac{A_G\varepsilon_G}{d_G}$$

Charge conservation dictates that $$Q_C = Q_G$$

Additionally, the two constraints on the voltages are $$V = V_C + V_G$$

$$V_C C_C = V_G C_G$$

Solving for VG leads to:

$$V_G = \frac{A_C d_G V \varepsilon_C}{A_C d_G \varepsilon_C + A_G d_C \varepsilon_G}$$

This equation can be further simplified by assuming that microfluidic control channel 110 and microfluidic channel 105 have similar dimensions, thereby leading to the areas and distances being identical. Under this assumption:

$$V_G = \frac{V\varepsilon_C}{\varepsilon_C + \varepsilon_G}$$

Finally, $\in_C$ is itself variable depending on the presence or absence of droplet 112*b* affecting the voltage potential between electrodes 115 and 120. Hence, $V_G = V_G(x)$ wherein x=1 when droplet 112*b* is present, and x=0 when droplet 112*b* is absent. Assuming oil is the first fluid (the carrier through which the second fluid moves), water the second fluid, and GER is used as a toggle element that is settable to one of two physical conditions, then $\in_G \approx 60$, $\in_{H2O} \approx 80$, and $\in_{OIL} \approx 2$.

When droplet 112*b* is not present and $\in_C = \in_{OIL}$ then $$V_G(0) = \frac{1}{31}V$$

When droplet 112*b* is present and $\in_C = \in_{H2O}$ then $$V_G(1) = \frac{4}{7}V$$

As can be understood, $V_G(1)$ and $V_G(0)$ can be suitably selected in relation to one or more threshold voltage values (potential values such that the GER solidifies) using the equations shown above for transforming GER fluid 106 from a liquid state to a solid state such that Vg(0)<Vthresh and Vg(1)>Vthresh.

FIG. 5 is a table showing the various states of GER 106 when droplet 112*b* (consisting of water) is either present or absent at an intersection of transverse axis 135 in microfluidic control channel 110. The table shows that GER fluid 106 has an "off" state and an "on" state defined by rheological states (a liquid state or an anisotropic solid state, respectively). The configuration of these two states can be used to define a further output state of GER flow 108 (FIG. 2) that depends on the rheological state of GER in 107. When the signal in 107 is "off" (i.e. the GER is in the liquid state), GER 106 can flow out GER channel 105. When the signal in 107 is "on" (i.e. the GER is in the solid state), GER flow is impeded and cannot flow out of GER channel 105. Thus, the state of GER in area 107 can be used to define a dependent state of GER flow out of GER channel 105 that depends immediately on the state of GER in area 107, and indirectly on the presence or absence of droplet 112*b* in the transverse intersection between 120 and 130. The binary states of GER fluid 106 may be exploited for various purposes such as measuring or controlling the amount of GER fluid 106 flowing out of microfluidic channel 105; for controlling other elements external to microfluidic channel 105; and/or using the binary flow in binary devices or systems.

Figure 6:
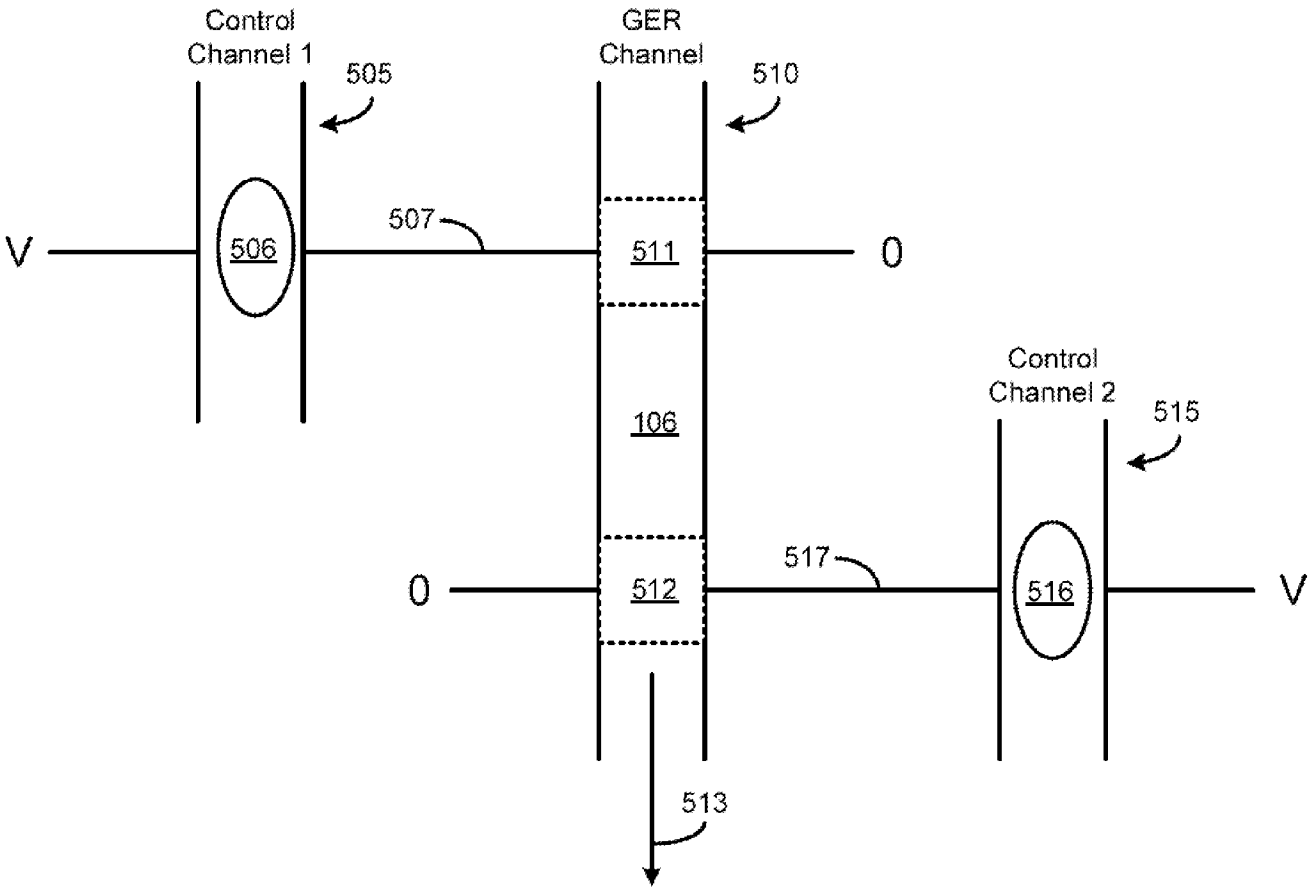
FIG. 6 shows two microfluidic channel configured as control channels that interact with a third microfluidic channel in a configuration that provides an OR logic functionality.

FIG. 6 shows a first embodiment wherein the binary flow nature of a microfluidic channel 510 is controlled for implementing an OR logic functionality. In this embodiment, any one of two asserted input conditions produces an asserted output condition. In other words, this embodiment represents the OR logic equation generally used in Boolean algebra. The two logic inputs are provided via two microfluidic control channels 505 and 515, while the output logic condition is provided by a pair of serially linked logic structures, which could include a microfluidic channel, such as microfluidic channel 510 (which will be referred to hereafter as GER channel 510 solely for convenience in description).

The location of a droplet 506 in the first microfluidic control channel 505 (intersecting voltage potential axis 507) determines the liquid/solid state of region 511 of GER fluid 106. Similarly, a location of a droplet 516 in the second microfluidic control channel 515 (intersecting voltage potential axis 517) determines the liquid/solid state of region 512 of GER fluid 106 in GER channel 510. As can be understood, when either region 511 or region 512 turns solid, the flow 513 of GER fluid 106 out of GER channel 510 is blocked. This blockage is interpreted as an asserted OR output condition. This interpretation can be generalized to any serially linked structures such that the assertion of either inputs 505 or 515 (or both) leads to a condition where flow in a third channel is blocked, whether by the solidification of GER fluid, or by the closing of a deformable membrane into another microfluidic structure.

Figure 7:
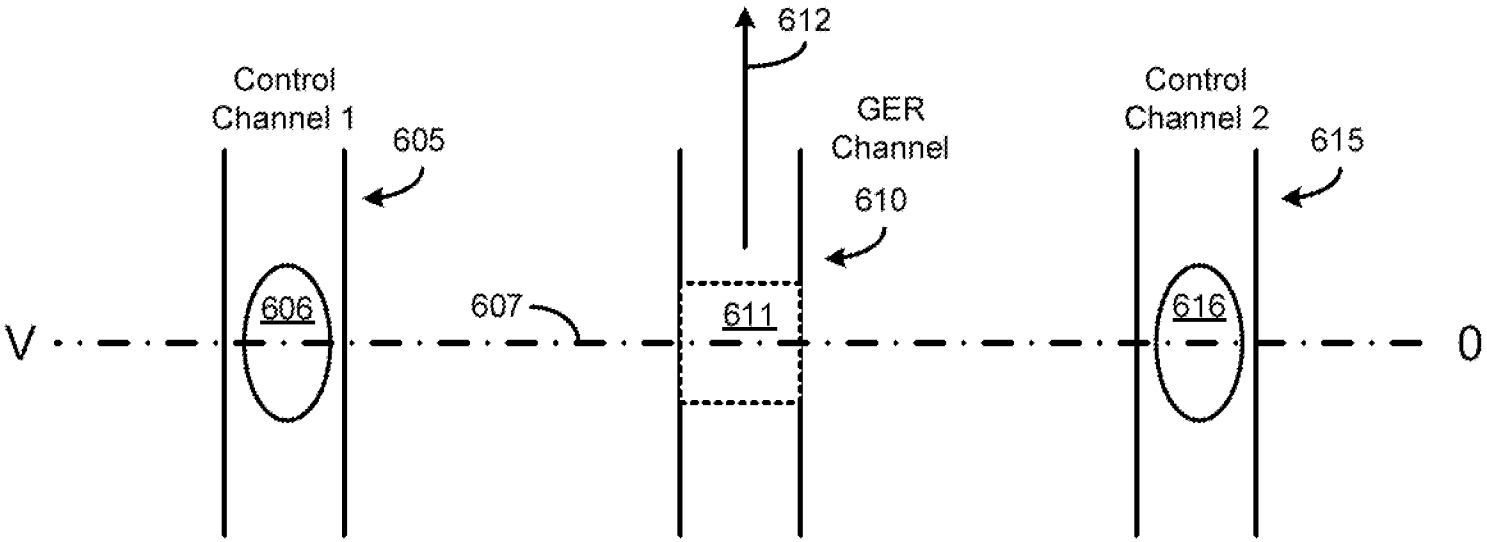
FIG. 7 shows two microfluidic channel configured as control channels that interact with a third microfluidic channel in a configuration that provides an AND logic functionality.

FIG. 7 shows a second embodiment wherein the binary flow nature of a microfluidic channel 610 is controlled for implementing an AND logic functionality. In this embodiment, an AND combination of two input conditions produces an asserted output condition. In other words, this embodiment represents the Boolean AND logic equation. The two logic inputs are provided via two microfluidic control channels 605 and 615, while the output logic condition is provided by a microfluidic channel 610 (which will be referred to hereafter as GER channel 610 solely for convenience in description).

The location of a first droplet 606 in the first microfluidic control channel 605 (intersecting voltage potential axis 607) as well as a similar position of a second droplet 616 in the second microfluidic control channel 615 (intersecting the same voltage potential axis 607) determines the liquid/solid state of region 611 of GER fluid 106. As can be understood, when either of first droplet 606 or the second droplet 616 is not positioned in the voltage potential axis 607, region 611 of GER fluid 106 does not transition from a liquid to a solid state, thereby allowing GER fluid 106 to generate a flow 612 out of GER channel 610. In contrast, when both the first and the second droplets are positioned appropriately, region 611 of GER fluid 106 transitions from a liquid to a solid state, thereby blocking the flow 612 out of GER channel 610. This blockage is interpreted as an asserted AND output condition, and results from the electrical necessity of having voltage transmitted to 607 from the left electrode and to 608 from the right electrode before sufficient voltage potential can be established across 611.

Figure 8:
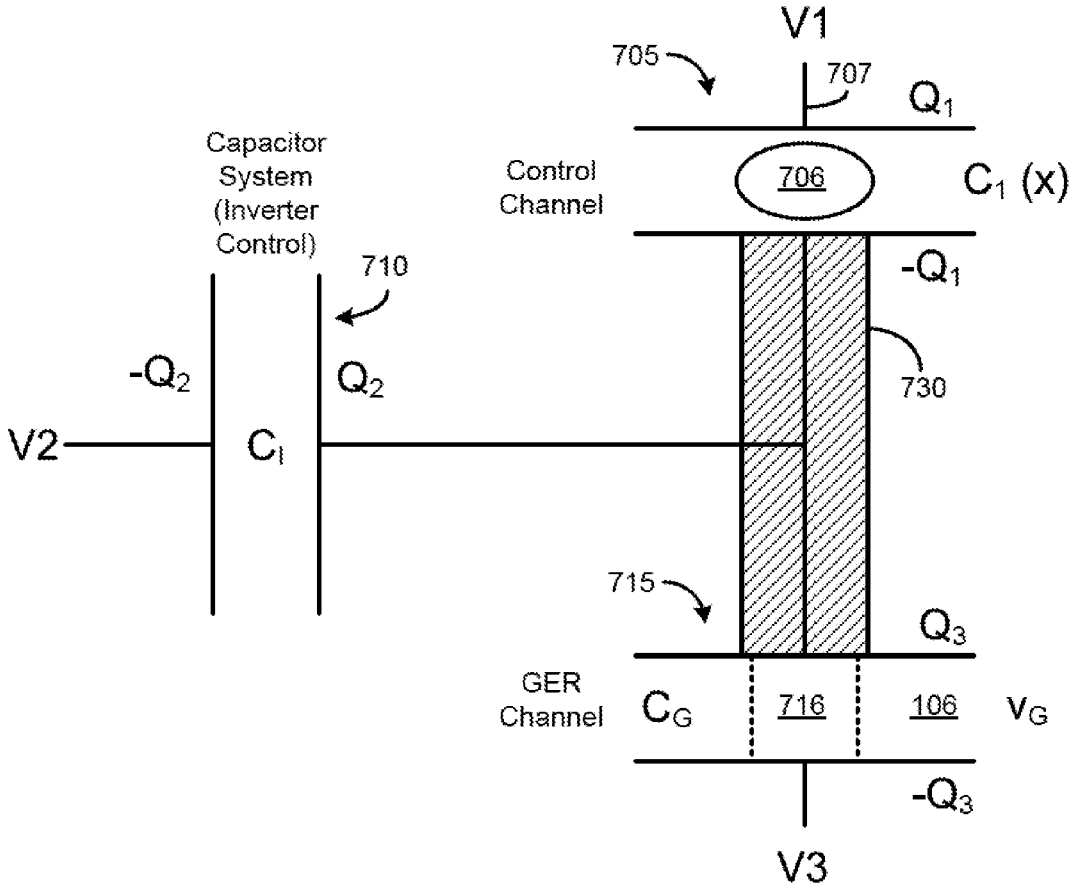
FIG. 8 shows a capacitor element that operates in conjunction with a microfluidic control channel for interacting with a second microfluidic channel in a configuration that provides an INVERTER logic functionality.

FIG. 8 shows a third embodiment wherein the binary flow nature of a microfluidic channel 715 is controlled for implementing an INVERTER logic functionality. The logic input is provided via a microfluidic control channel 705, while the output logic condition is provided by a microfluidic channel 715, which will be referred to hereafter as GER channel 715 solely for convenience in description. The specific choice of use for FIG. 7 is not limited to inversion and can be chosen to form a more general manifestation of the switch in FIG. 1 or an INVERTER mechanism, depending on choices of voltages used. FIG. 7 will be alternatively referred to as an inverter mechanism solely for convenience in description, description not limiting its service in other functional capacities.

The location of a droplet 706 in the microfluidic control channel 705 (intersecting voltage potential axis 707) changes the liquid/solid state of region 716 of GER fluid 106 in GER channel 715. As can be understood, when droplet 706 is moved away from a position that intersects the voltage potential axis 707, region 716 of GER fluid 106 transitions from a solid state to a liquid state. In one embodiment, the solid state of region 716 is set as a default state, activated for default times when droplet 706 is not present. The default state is set using a capacitor system 710, which is configured to couple a voltage potential (a default, quiescent state voltage) into separation barrier 730. In an alternate embodiment, the voltage potential may be coupled directly into GER channel 715 and/or may be coupled into separation barrier 730. Irrespective of the nature of the coupling, the voltage potential causes region 716 of GER fluid 106 to be set to a default state that is changed to an opposite state (inversion) by suitably positioning droplet 706 to either intersect or not intersect voltage potential axis 707.

Capacitor system 710 may be implemented in a variety of ways. A few non-limiting examples include a capacitor that is fabricated directly on or inside a substrate (not shown) in which GER channel 715 is located. Semiconductor techniques for capacitor fabrication may be used. In another example implementation, a discrete capacitor or a portion of a discrete capacitor (a capacitor plate, for example) is mounted on the substrate. The adjacent location may be on the same layer of the substrate on which separation barrier 730 and/or GER channel 715 are located, or may be on a different layer, for example either above or below the layer on which separation barrier 730 and/or GER channel 715 are located. In a third example, the capacitor is built between layers of substrate.

The electrical behavior of the INVERTER configuration shown in FIG. 8 will now be described in further detail.

$Q1=Q2+Q3$ (balance of charges inside the non-grounded portion 730)

$Q1=C1v1;\ Q2=C2v2;$ and $Q3=Cgv_G$ wherein "vx" represents the voltage potential across each of microfluidic control channel 705, capacitor system 710, and GER channel 715 respectively)

$V1-v1=V2+v2=V3+v_G$ (voltage in the central region must be the same regardless of which channel is chosen as a reference)

Solving for vg (and setting the capacitance CI of capacitor system 710 such that $C_I=f*C_G$ where f is any selected ratio):

$$v_G=\frac{V3(\varepsilon_1+f\varepsilon_3)-V1\varepsilon_1-fV2\varepsilon_3}{\varepsilon_1+\varepsilon_3(1+f)}$$

In one embodiment, the capacitance value of capacitor system 710 is similar to that of GER channel 715 (f≈1). The values for vG under this condition (and using values as described above in other equations) can be determined as follows:

$$v_G(0) = \frac{-1}{61}(V1 + 30V2 - 31V3)$$

$$v_G(1) = \frac{-1}{10}(4V1 + 3V2 - 7V3)$$

By suitably configuring the various voltages, like an embodiment in which voltages are chosen such that V1=−V2=V and V3=0, the values for $v_G$ (0) and $v_G$ (1) are as follows:

$$v_G(0) = \frac{29V}{61} \approx \frac{V}{2}$$

$$v_G(1) = \frac{V}{10}$$

The amplitude of voltage V is selected such that the solidification threshold of GER fluid 106 in GER channel 715 is crossed only when droplet 706 is absent, i.e. V/10<Vthresh<V/2. Droplet 706 may be positioned to intersect voltage potential axis 707 subsequently when the INVERTER action is desired.

In an alternate interpretation of the inverter mechanism, droplet 706 is an electrically conductive fluid, but the carrier fluid (the fluid present in channel 705 that contains droplet 706) is electrically non-conductive. In this embodiment, capacitor C1 can be set to be very large, such that the voltage in 730 approaches the value set by V2 when droplet 706 is not present. When droplet 706 is present along axis 707, then electrical current can pass through droplet 706, and set the voltage of 730 to V1. Because conductive droplet 706 can physically allow charge to be added to 730, its effect will dominate the polarization effect caused by the capacitor C1. If capacitor C1 is set to be large enough, the electrical voltages in 730 will approach the result: V(730)=V2 if no droplet 706; V(730)=V1 if droplet 706.

Figure 9:
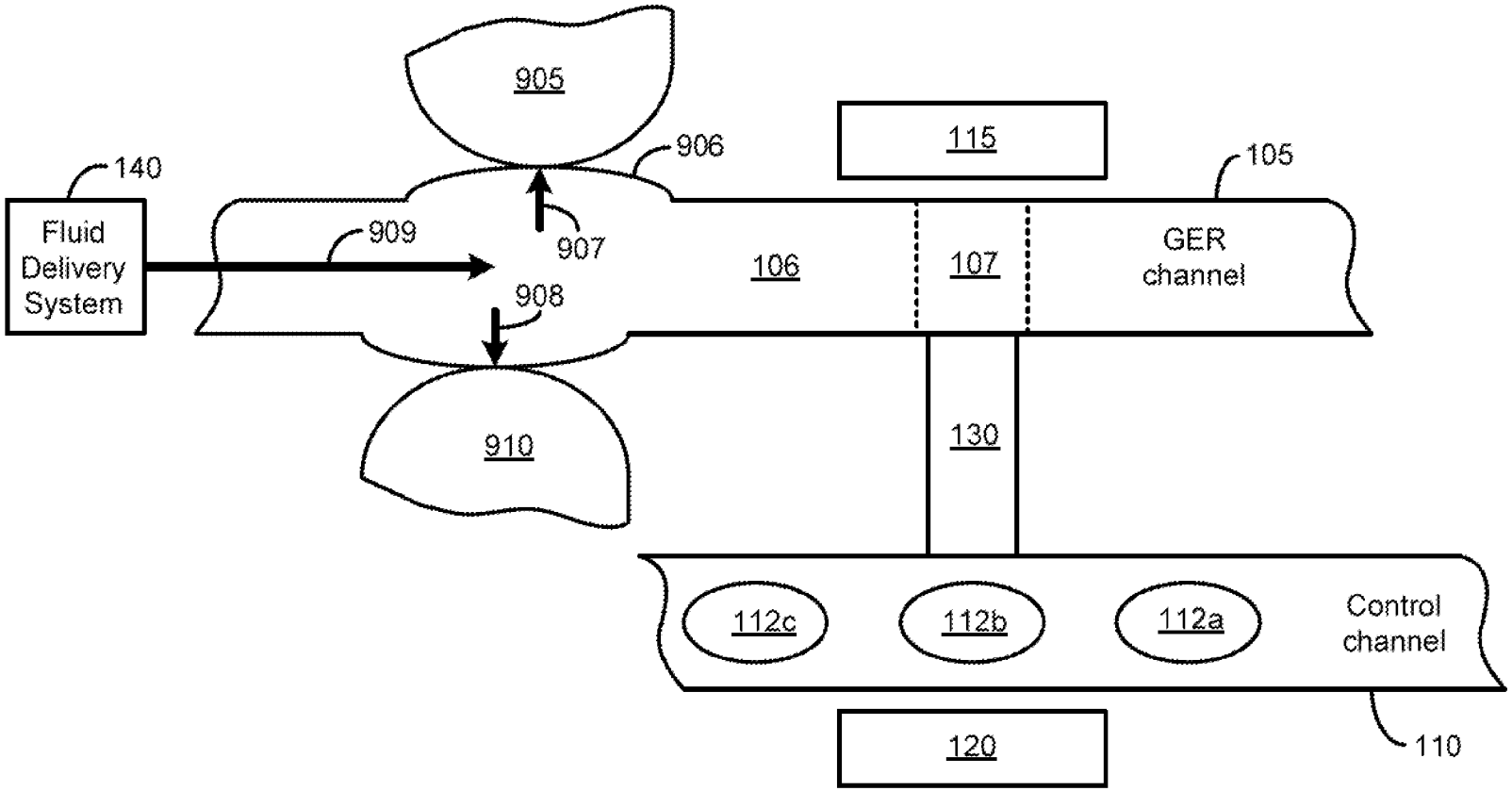
FIG. 9 shows the configuration of FIG. 2 used in a control application for operating one or more external elements.

FIG. 9 shows GER channel 105 configured for a control functionality, specifically to activate an external element such as a switch or a valve. In the example configuration shown in FIG. 9, the external element is shown as a first element 905 located above GER channel 105 and a second element 910 that may be placed below GER channel 105. These two positions are shown solely for purposes of describing a push-up and a push-down type of action. It will be understood that one or more of such external elements may be placed in various other locations and orientations with respect to GER channel 105. Furthermore, it is not necessary that both element 905 and element 910 be employed. In certain applications only one of these two elements may be used, while in certain other applications, more than two elements may be controlled. Furthermore, it is not necessary that GER be used in channel 105 (in various forms); some general, unspecified control mechanism actuated by an electric signal could be used in an alternate capacity to activate possible push-up or push-down valves 905.

In an embodiment utilizing GER fluid in 105, when droplet 112*b* is positioned in microfluidic control channel 110 as shown, area 107 in GER channel 105 transitions from a liquid state to a solid state. Upon occurrence of this solidification, additional GER fluid 106 that is forced into GER channel 105 by fluid delivery system 140 along path 909 is blocked thereby causing pressure between the Fluid Delivery System 140 and area 107 to experience a buildup of pressure. Due to the flexibility of the membranes at 906, this will cause GER fluid 106 to move radially outwards. The direction indicated by arrow 907 may be used to expand surface 906 of GER channel 105 to expand and apply pressure against element 905. This pressure is used to carry out a control operation, such as for example, a switch activation when element 905 is a switch. When element 905 is a channel carrying a fluid, the pressure may result in a constriction of a surface of the channel which can modulate the flow of fluid inside. GER fluid 106 expansion in the direction indicated by arrow 908 may be similarly used for controlling the other element 910.

Figure 10:
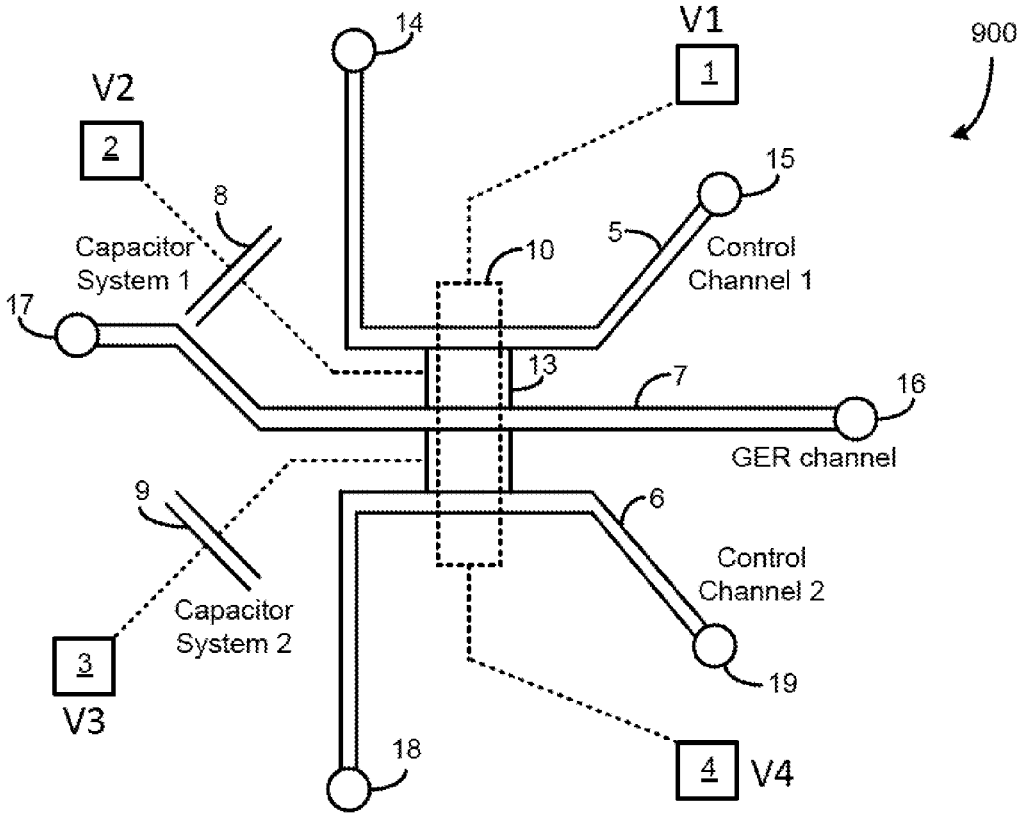
FIG. 10 shows a universal logic device incorporating microfluidic channels and capacitor elements.
Figure 11:
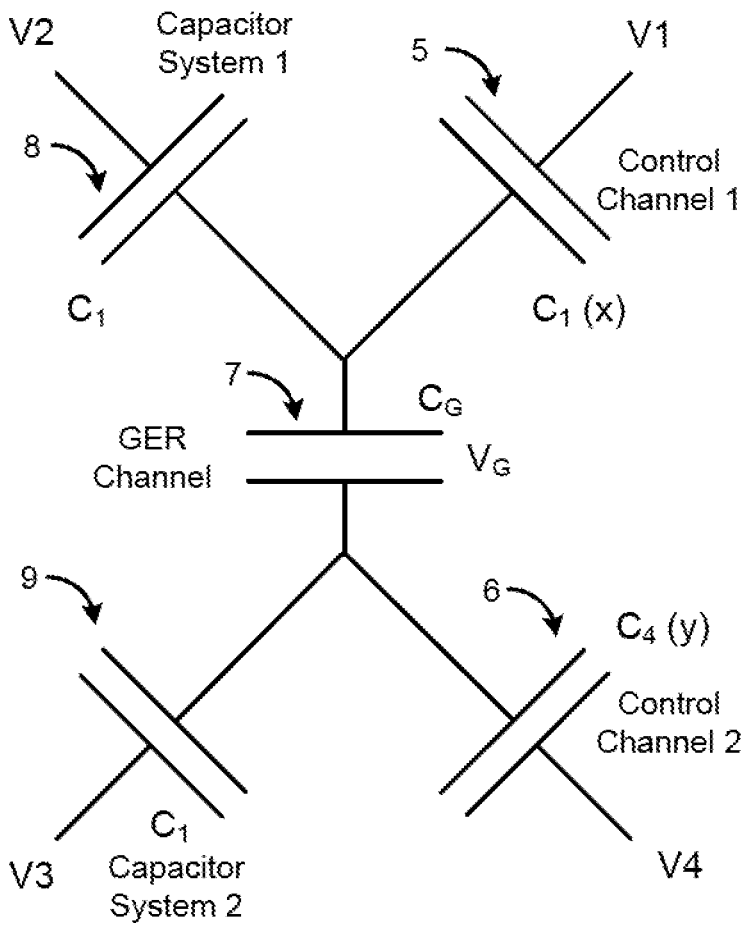
FIG. 11 shows an equivalent electrical circuit of the universal logic device shown in FIG. 10.

FIG. 10 shows a universal logic device 900 incorporating microfluidic channels and a capacitor system in specific configurations can be implemented as logic an effective joining of inverter mechanisms into a structure exhibiting AND functionality (as in FIG. 7). Two inverter mechanisms can also be combined into a structure exhibiting OR functionality (as in FIG. 6). Such a universal logic device may be used in a variety of applications, including one that is referred to in the industry, as a lab-on-a-chip (LOC). Unlike traditional LOC devices, which include various external elements for control and monitoring purposes, universal logic device 900 incorporates numerous functionalities intrinsically, thereby providing logistic and performance advantages over traditional LOC devices.

Specifically, universal logic device 900 includes a GER channel 7, a first microfluidic control channel 5, a second microfluidic control channel 6, an electrode system that includes electrodes 1-4, and a pair of capacitor systems 8 and 9. Each of the capacitor systems provides an INVERTER functionality to be implemented in universal logic device 900, while the remaining elements enable universal logic device 900 to be configured for a variety of logic operations. Unlike traditional approaches wherein several NAND gates or NOR gates are combined together to implement even simple binary logic functions, the universal logic device 900 permits implementation of these same binary logic functions using a single logic gate mechanism. Like NAND and NOR logic, universal logic device 900 can also be combined together with other logic devices to enable further more complicated logic functions.

The voltages applied to the various electrodes 1-4 and the position of droplets inside microfluidic control channels 5 and 6, determine which of sixteen possible logical operations can be implemented in universal logic device 900. Of the four electrodes, two electrodes 1 and 4 (V1 and V4) (in conjunction with an electrode connection area 10 if needed) are used for configuring the two control channels, while the two other electrodes 2 and 3 (V2 and V3) are used for the capacitor system in order to implement INVERTER functionality. Capacitor systems 8 and 9 couple into separation barrier 13, suitable voltages to set the GER fluid inside GER channel 7 to a default state. GER fluid is introduced into, and exits from, GER channel 7 via ports 16 and 17. Similarly, fluid introduction and exit from microfluidic control channels 5 and 6 are carried out via ports 14/15, and 18/19 respectively. Ports may also be interpreted as continuations of the microfluidic channels into other portions of a larger device, here unspecified.

The electrical behavior of universal logic device 900 will now be described using the simplified circuit diagram FIG. 10. Assuming that the INVERTER circuitry operates in the same fashion as described above, the voltage potential $v_G$ across GER channel can be defined by the following expression:

$$v_G = \frac{V4\varepsilon_4(\varepsilon_1 + f\varepsilon_G) - V1\varepsilon_1(\varepsilon_4 + f\varepsilon_G) + f\varepsilon_G(V3(\varepsilon_1 + f\varepsilon_G) - V2\varepsilon_1(\varepsilon_4 + f\varepsilon_G)}{\varepsilon_1(\varepsilon_4 + \varepsilon_G + f\varepsilon_G) + \varepsilon_G(1 + f)\varepsilon_4 + f(2 + f)\varepsilon_G)}$$

The truth table of the various combinations and corresponding voltage amplitudes is shown in FIG. 12. The truth table can be used to configure universal logic device 900 for implementing at least sixteen logical conditions by manipulating the various voltage levels and the droplets in the control channels without a modification of the basic structure inside universal logic device 900.

FIGS. 13 and 14 provide a detailed diagram listing various voltages and input polarities that can be used for operating universal logic device 900 in the various logical modes. It will be understood that the listing is non-exhaustive in nature and several other modes may be applicable other than the one shown. The general guide to interpreting FIGS. 13 and 14 is as follows: all polarities (+, −, 0, ++, −−) are relative and occur in the following order: (++, +, 0, −, −−) in order of voltage potential, representing for the purposes of the diagram the values of (2, 1, 0, −1, −2). A blank space represents an unconnected voltage terminal. The phrase "channel A" refers to microfluidic control channel 5 while "channel B" refers to microfluidic control channel 6.

The idealized voltage potential across the activation mechanism can be determined as follows:

1) The potential difference across the activation mechanism is assumed to be the absolute value of the difference between the one active voltage in set {A} (i.e. V1, V2) and the one active voltage in set {B} (i.e. V3, V4).

2) An absolute value difference of greater than 2 is sufficient to activate the actuator mechanism or signal chosen for the particular application of the logic device 3) The active voltages are determined as follows:

a) if neither channels A nor B are activated (i.e. both are in the fluidic "0" state), the active voltages are, by default {A}=V2 and {B}=V3 b) if channel A is set in the "1" state, then {A} takes the value of V1 instead of V2 c) if channel B is set in the "1" state, then {B} takes the value of V4 instead of V3 d) if both A and B are in the "1" state, then b and c still apply

4) The exception to the above rules occurs when a blank value (blank space) is involved. The blank space effectively indicates no voltage potential, and is therefore set by the nearest active value.

a) V1 or V4=blank value: the values of {A} or {B} are independent of the fluidic state in channels A or B, respectively b) V2 or V3=blank value i) If channels A or B (respectively) are active, then V2 or V3 are overridden according to the rules defined in item 3) above.

ii) A="0" and V2=blank value, then {A} takes the value of {B} iii) B="0" and V3=blank value, then {B} takes the value of {A} iv) A="0" and B="0" and V2=blank value and V3=blank value. Then {A} and {B} are functionally set to 0.

5) The specific values displayed in the truth table are arbitrary provided that the correct absolute value is maintained when the above rules are applied.

Figure 15:
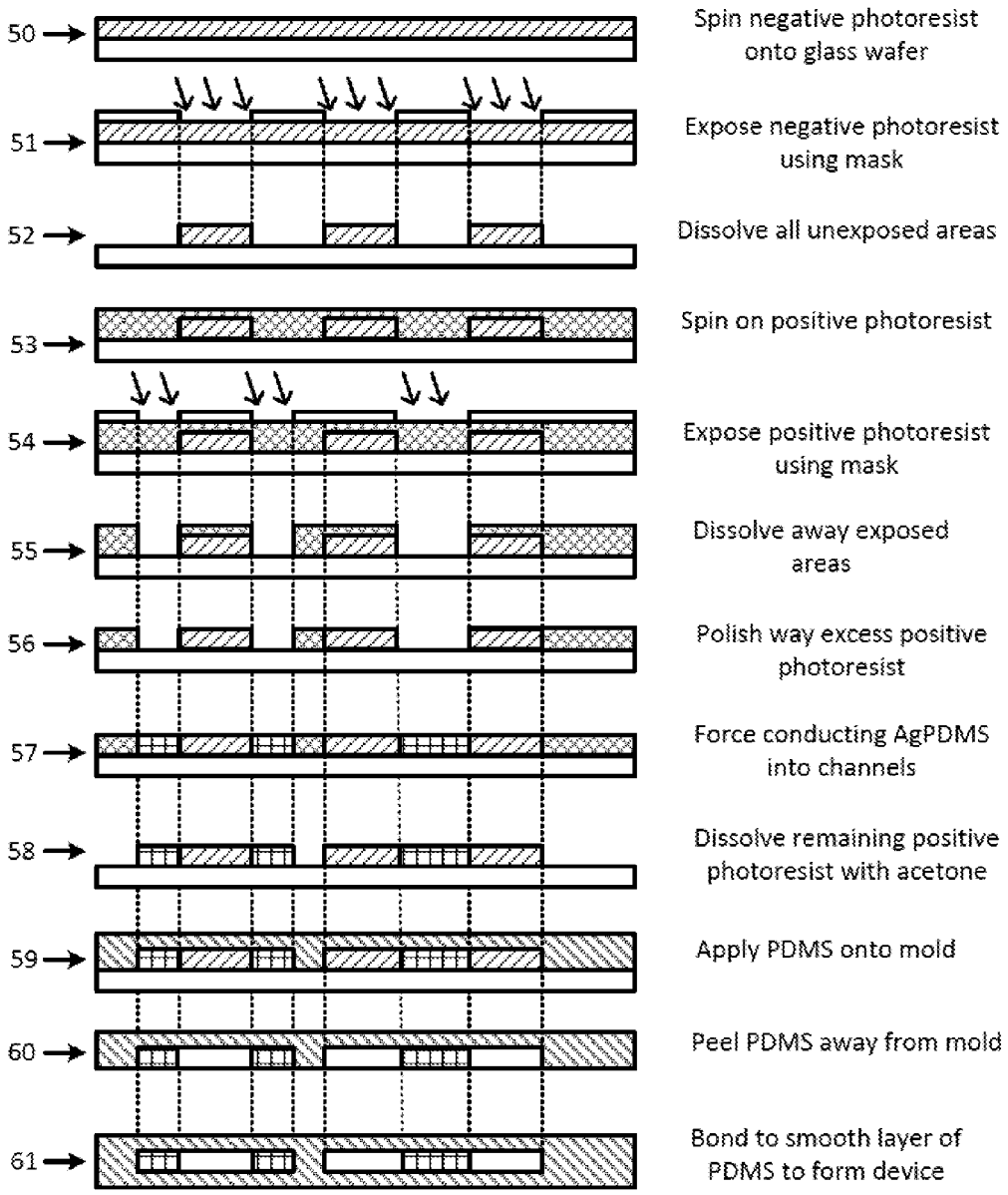
FIG. 15 shows various process steps associated with manufacturing a logic device incorporating one or more microfluidic channels.

FIG. 15 shows various process steps associated with manufacturing a logic device incorporating one or more microfluidic channels. The steps can be broken up into two parts wherein a first part involves the development of a suitable mold, and a second part involves manufacturing a device using the mold. Typically, photolithographic techniques may be used for a number of steps in the manufacturing process. A non-exhaustive list of these steps is provided below.

Spin a negative photoresist (such as SU8, for example) on to a glass substrate (step 50 in FIG. 13). Expose and develop the negative photoresist in a suitable development process (steps 51 and 52). Spin a positive photoresist (such as AZ4903) on top of the negative photoresist. This can be done multiple times so as to obtain a thickness of about 80 μm. The positive photoresist is developed (using a developer such as AZ400K:DI water=1:3 volume) to form a set of electrode cavities. The mold is then completed by applying surface polishing or sanding as needed (steps 53-56).

The logic device can then be manufactured using the mold as described hereafter. The electrode material (AgPDMS, for example) is filled into the cavities of the mold (step 57). Excess AgPDMS may be removed and the surface cleaned. The assembly is then baked in an oven at approximately 60 degrees for approximately 30 minutes to cure the AgPDMS. Pour a PDMS gel into the mold and bake in the oven at approximately 60 degrees for approximately 2+ hours to cure the PDMS. Peel the PDMS together with the AgPDMS electrodes from the glass substrate (step 60). Using a half-bake method, seal the device onto a flat PDMS layer (step 61). The sealed assembly is then baked on a hotplate at approximately 150 degrees for over 2 hours to finalize the manufacturing process.

All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The examples set forth above are provided to give those of ordinary skill in the art a complete disclosure and description of how to make and use the embodiments of the enhancement methods for sampled and multiplexed image and video data of the disclosure, and are not intended to limit the scope of what the inventors regard as their disclosure. Modifications of the above-described modes for carrying out the disclosure may be used by persons of skill in the video art, and are intended to be within the scope of the following claims.

A number of embodiments of the disclosure have been described. Nevertheless, it will be understood that various modifications may be made without departing from the spirit and scope of the present disclosure. Accordingly, other embodiments are within the scope of the following claims.

What is claimed is:

1. A fluidic device for generating binary states, the device comprising:

a first fluidic channel;

a separation barrier;

a second fluidic channel separated from at least a part of the first fluidic channel by the separation barrier;

an electrode system arranged to provide a voltage potential that traverses at least a portion of the first fluidic channel, at least a portion of the separation barrier, and at least a portion of the second fluidic channel;

a first fluid delivery system configured for introducing into the at least a portion of the first fluidic channel, a first fluid at a first instant in time and a second fluid at a second instant in time, wherein the first and the second instants in time correspond to a first binary state and a second binary state characterized by a first voltage differential and a second voltage differential respectively across the at least a portion of the first fluidic channel as a result of the first and second fluids being present in the at least a portion of the first fluidic channel at the first and the second instants in time; and a second fluid delivery system configured for introducing into the at least a portion of the second fluidic channel a third fluid at the first or second instant in time, wherein the third fluid is settable in correspondence to the first or second instants in time to a first physical condition corresponding to the first binary state or a second physical condition corresponding to the second binary state;

wherein the first fluid and the second fluid differ from each other in at least one of a) dielectric constant or b) electrical conductivity.

2. The device of claim 1, wherein the third fluid comprises an electro-rheological fluid.

3. The device of claim 1, wherein introducing the second fluid into the at least a portion of the first fluidic channel comprises introducing at least one droplet of the second fluid into the first fluid.

4. The device of claim 1, wherein the at least a portion of the first fluidic channel is configured as a control channel for generating the first and the second binary states in at least one of a) a logic gate, b) a switch control system, or c) a laboratory-on-a-chip implementation.

5. The device of claim 1, wherein the separation barrier comprises at least one of a) a fluidic barrier, or b) a material that is at least partially conductive to electricity.

6. The device of claim 1, wherein the at least a portion of the first fluidic channel is oriented substantially parallel to the at least a portion of the second fluidic channel.

7. The device of claim 1, wherein the at least a portion of the first fluidic channel is configured as a control channel for generating the first and the second physical conditions in the at least a portion of the second fluidic channel component, and wherein at least one of the first or the second fluidic channels is a part of at least one of a) a logic gate, b) a switch control system, or c) a laboratory-on-a-chip implementation.

8. The device of claim 7, wherein the logic gate operates using Boolean logic.

9. The device of claim 1, wherein the at least a portion of the first fluidic channel is configured as a control channel for generating the first and the second physical conditions in the at least a portion of the second fluidic channel, and wherein at least one of the first or the second fluidic channels is a part of a universal logic device that is configurable for executing any one or more of a plurality of logic functions.

10. The device of claim 2, wherein the first physical condition comprises a substantially solid state of the electro-rheological fluid, and the second physical condition comprises a substantially liquid state of the electro-rheological fluid.

11. The device of claim 10, wherein the substantially solid state is an anisotropic solid state.

12. The device of claim 10, wherein the at least a portion of the first fluidic channel is configured as a control channel for generating the first and the second physical conditions in the at least a portion of the second fluidic channel, and wherein the first and the second physical conditions are used for controlling fluidic flow in at least a portion of a third fluidic channel.

13. The device of claim 12, wherein controlling fluidic flow in the at least a portion of the third fluidic channel comprises changing the electro-rheological fluid from the substantially liquid to the substantially solid state thereby applying switch actuation pressure upon a surface of the third fluidic channel.

14. The device of claim 1, wherein the separation barrier is configured to at least a) prevent the first fluid from making contact or mixing with the second fluid, and/or b) permit transmission of some fraction of a pre-determined amplitude of said voltage potential to trigger a transition between the first and the second physical conditions in the electro-rheological fluid.

15. A method of generating binary states, the method comprising:

applying a voltage potential that traverses at least a portion of a first fluidic channel and at least a portion of a second fluidic channel;

positioning one of a first fluid or a second fluid inside the at least a portion of the first fluidic channel for modifying the voltage potential on the basis of at least one of a first dielectric constant or a first conductivity associated with the first fluid and at least one of a second dielectric constant or a second conductivity associated with the second fluid; and positioning one of the first fluid or the second fluid inside the at least a portion of the first fluidic channel such that the voltage potential is modified at selected instants in time thereby triggering corresponding transitions between a first physical condition and a second physical condition in a third fluid in the second fluidic channel.

16. The method of claim 15, wherein the third fluid comprises an electro-rheological fluid.

17. The method of claim 16, wherein the first physical condition comprises a substantially solid state of the electro-rheological fluid, and the second physical condition comprises a substantially liquid state of the electro-rheological fluid.

18. The method of claim 17, wherein the first and the second physical conditions constitute binary states for implementing binary logic devices.

19. The method of claim 15, wherein positioning one of the first fluid or the second fluid inside the at least a portion of the first fluidic channel comprises introducing a first quantity of the first fluid into the at least a portion of the first fluidic channel at a first instant in time, and introducing a second quantity of the second fluid into the at least a portion of the first fluidic channel at a second instant in time.

20. The method of claim 19, wherein the first quantity is the same as the second quantity.

21. The method of claim 19, wherein at least one of the first or the second quantity corresponds to at least one droplet.

22. The method of claim 15, wherein positioning one of the first fluid or the second fluid inside the at least a portion of the first fluidic channel comprises moving a quantity of at least one of the first fluid or the second fluid from a first position inside the first fluidic channel to a second position inside the first fluidic channel.

23. The method of claim 15, wherein positioning one of the first fluid or the second fluid inside the at least a portion of the first fluidic channel comprises introducing at least one droplet of the second fluid into the first fluid.

24. A fluidic system for generating binary states, the system comprising:

a first fluidic control channel containing a first fluid through which is transported at least a first droplet comprising a second fluid;

an actuator system comprising a toggle element that is settable to one of a first physical condition or a second physical condition upon subjecting the toggle element to a corresponding one of a first voltage potential or a second voltage potential that is generated as a result of the first droplet being located at one of a first position or a second position in the first fluid;

a separation barrier between the first fluidic channel and the actuator system; and an electrode system arranged to provide a voltage potential that traverses at least a portion of the first fluidic channel, the separation barrier, and the actuator system, thereby providing a voltage differential across the toggle element, wherein the toggle element toggles to the first physical condition or the second physical condition upon subjecting the toggle element to a corresponding one of a first voltage differential or a second voltage differential that is generated as a result of the first droplet being located at least one of a first position or a second position in the first fluidic channel.

25. The fluidic system of claim 24, wherein the actuator system comprises a second fluidic channel and the toggle element therein comprises electro-rheological fluid; wherein the first physical condition is a substantially liquid condition that permits a flow of the electro-rheological fluid through the at least one portion of the second fluidic channel, at least one of the substantially liquid condition or the permission of flow indicative of the first binary state; and wherein the second physical condition is a substantially solid condition that blocks a flow of the electro-rheological fluid through at least a portion of the second fluidic channel, at least one of the substantially solid condition or the blockage of flow indicative of a second binary state.

26. The fluidic system of claim 24, comprising an arrangement that provides an OR logic functionality, the arrangement comprising:

a second fluidic control channel containing a third fluid through which is transported at least a second droplet comprising a fourth fluid;

wherein the actuator system comprises a third fluidic channel and the toggle element therein comprises electro-rheological fluid;

at least a portion of the first fluidic control channel is arranged substantially parallel to and along one side of at least a portion of the third fluidic channel with a first separation barrier therebetween;

at least a portion of the second fluidic control channel is arranged substantially parallel to and along an opposing side of the at least a portion of the third fluidic channel with a second separation barrier therebetween;

a first set of electrodes arranged for providing a first voltage potential that traverses the at least a portion of the first fluidic control channel, the first separation barrier, and the at least a portion of the third fluidic channel, and sets the electro-rheological fluid in a first portion of the third fluidic channel to one of a first physical condition or a second physical condition on the basis of a location of the first droplet in the at least a portion of the first fluidic control channel; and a second set of electrodes arranged for providing a second voltage potential that traverses the at least a portion of the second fluidic control channel, the second separation barrier, and the at least a portion of the third fluidic channel, and sets the electro-rheological fluid in a second portion of the third fluidic channel to one of the first physical condition or the second physical condition on the basis of a location of the second droplet in the at least a portion of the second fluidic control channel, wherein a change from the first to the second physical condition in either the first or the second portion of the third fluidic channel provides the OR logic functionality.

27. The fluidic system of claim 24, comprising an arrangement that provides an AND logic functionality, the arrangement comprising:

a second fluidic control channel containing a third fluid through which is transported at least a second droplet comprising a fourth fluid;

at least a portion of the first fluidic control channel is arranged substantially parallel to and along one side of at least a portion of the actuator system with a first separation barrier therebetween;

at least a portion of the second fluidic control channel is arranged substantially parallel to and along an opposing side of the at least a portion of the actuator system with a second separation barrier therebetween; and a first set of electrodes arranged for providing a first voltage potential that traverses the at least a portion of the first fluidic control channel, the first separation barrier, the at least a portion of the actuator system, the second separation barrier and the at least a portion of the second fluidic control channel, and sets the toggle element to one of the first physical condition or the second physical condition on the basis of a location of the first droplet in the at least a portion of the first fluidic control channel and a location of the second droplet in the at least a portion of the second fluidic control channel thereby providing the AND logic functionality.

28. The fluidic system of claim 24, arranged inside a universal logic device that is configurable for executing any one or more of a plurality of logic functions, the universal logic device further comprising at least one of:

a second fluidic control channel containing a third fluid through which is transported at least a second droplet comprising a fourth fluid;

a first capacitor element for capacitively coupling a third voltage potential into at least one of a) the actuator system or b) a first separation barrier located between the first fluidic control channel and the actuator system; or a second capacitor element for capacitively coupling a fourth voltage potential into at least one of a) the actuator system or b) a second separation barrier located between the second fluidic control channel and the actuator system.

29. The fluidic system of claim 28, wherein the actuator system comprises a third fluidic channel and the toggle element therein comprises electro-rheological fluid.

30. The fluidic system of claim 28, wherein the universal logic device is configurable for at least one of: a) selectively enabling at least one of the first or the second capacitor elements from providing the coupling of the third or the fourth voltage potentials respectively, b) selectively disabling at least one of the first or the second capacitor elements from providing the coupling of the third or the fourth voltage potentials respectively, or c) selectively disconnecting at least one of the first or the second capacitor elements.

31. The fluidic system of claim 24, further comprising an arrangement that provides for relay logic, the arrangement comprising:

a second toggle element settable to a third physical condition or a fourth physical condition upon subjecting the toggle element to a third voltage potential or a fourth voltage potential; and at least one of:

a) a second fluidic channel containing a third fluid through which is transported at least a second droplet comprising a fourth fluid; and a second electrode system which traverses at least a portion of the second fluidic channel, the separation barrier, and the second toggle element; wherein the third voltage differential or the fourth voltage differential in the second toggle element is generated as a result of a third droplet being located at one of a first position or a second position in the second fluidic channel; or b) a second electrode system which traverses at least a portion of a third location of the first fluidic channel, the separation barrier, and the second toggle element; wherein the third voltage differential or the fourth voltage differential in the second toggle element is generated as a result of a second droplet being located at one of a third position or a fourth position in the second fluidic channel; and wherein the binary state of the fluidic system is determined by the physical condition of two or more instances of the toggle element.

32. The fluidic system of claim 31, wherein the toggle elements of the fluidic system are further used for controlling fluidic flow in at least a portion of a third fluidic channel; and wherein the fluidic flow in the at least a portion of the third fluidic channel is substantially determined by the binary state of the fluidic system, the arrangement further comprising:

a first toggle element corresponding to a first location in the third fluidic channel, which permits fluidic flow in the third fluidic channel when set to the first physical condition and substantially blocks fluidic flow when set to the second physical condition; and a second toggle element corresponding to a second location in the third fluidic channel, which permits fluidic flow in the third fluidic channel when set to the third physical condition and substantially blocks fluidic flow when set to the fourth physical condition.

33. The fluidic system of claim 31, further comprising an arrangement that provides a relay-based OR logic functionality through serial arrangement of toggles, the arrangement comprising:

two or more toggle elements corresponding to positions located sequentially along an unbranching portion of the third fluidic channel, wherein flow through the unbranching portion of the third fluidic channel is permitted only when all toggle elements are set to the flow permitting condition, and wherein the flow is substantially blocked when one or more of the toggle elements is set to the substantially blocking condition.

34. The fluidic system of claim 31, further comprising an arrangement that provides a relay-based AND logic functionality through parallel arrangement of toggles, the arrangement comprising:

a first portion of the third fluidic channel, a branching portion of the third fluidic channel which splits into two or more branches, and a second portion of the third fluidic channel; and a toggle element corresponding to at least a portion of each of the branches of the branching portion of the third fluidic channel;

wherein flow through each individual branch is permitted when the corresponding toggle element is set to the flow permitting condition, and wherein the flow is substantially blocked when the corresponding toggle element is set to the substantially blocking condition; and flow from the first portion to the second portion of the third fluidic channel is only substantially blocked when the toggle elements in all individual branches are set to the substantially blocking condition.

35. The fluidic system of claim 24, further comprising an arrangement that provides for multi-component logic, the arrangement comprising at least one of:

a second fluidic channel containing a third fluid through which is transported at least a second droplet comprising a fourth fluid, and a second electrode system which traverses at least a portion of the second fluidic channel and which is coupled electrically with the first electrode system into at least one of a) the actuator system or b) a first separation barrier; or a second electrode system which traverses at least a portion of a third location of the first fluidic channel which is coupled electrically with the first electrode system into at least one of a) the actuator system or b) a first separation barrier;

wherein the toggle element is subjected to a voltage differential that is generated as a result of the fluid present within the at least a portion of the first fluidic channel and by the fluid present within at least one of a) the at least a portion of the second fluidic channel, or b) the third at least a portion of the first fluidic channel; and wherein the binary state of the fluidic system is determined by the physical condition the toggle element.

36. The fluidic system of claim 35, further comprising an arrangement that provides an AND logic functionality, the arrangement comprising:

a second fluidic control channel containing a third fluid through which is transported at least a second droplet comprising a fourth fluid;

at least a portion of the first fluidic control channel is arranged substantially parallel to and along one side of at least a portion of the actuator system with a first separation barrier therebetween;

at least a portion of the second fluidic control channel is arranged substantially parallel to and along an opposing side of the at least a portion of the actuator system with a second separation barrier therebetween; and a first set of electrodes arranged for providing a first voltage potential that traverses the at least a portion of the first fluidic control channel, the first separation barrier, and the at least a portion of the actuator system; and a second set of electrodes arranged for providing a second voltage potential that traverses the at least a portion of the second fluidic channel, the second separation barrier, and which is electrically coupled to the first set of electrodes;

wherein the first set of electrodes and the second set of electrodes set the toggle element to one of the first physical condition or the second physical condition on the basis of a location of the first droplet in the at least a portion of the first fluidic control channel and a location of the second droplet in the at least a portion of the second fluidic control channel thereby providing the AND logic functionality.

37. The fluidic system of claim 35, further comprising an arrangement that provides an OR logic functionality and an XOR logic functionality, the arrangement comprising at least one of:

a first set of electrodes that traverses the at least a portion of the first fluidic channel, the first separation barrier, and the toggle element; and a second set of electrodes that traverses at least one of a) the second fluidic channel, or b) the third at least a portion of the first fluidic channel; and which electrically couples with the first set of electrodes within the first separation barrier;

wherein the voltage potential applied to each of the first electrode system and the second electrode system provides that the logic device is configurable for at least one of:

an arrangement that provides an OR logic functionality, wherein the toggle element toggles from the first physical condition to the second physical condition on the basis of the presence of at least one of: a) a droplet of the second fluid at the first location in the first fluidic channel; or b) or at least one of i) a droplet of the fourth fluid at the first location in the second fluidic channel, or ii) a droplet of the second fluid at the third location of the first channel;

an arrangement that provides an XOR logic functionality, wherein the toggle element toggles from the first physical condition to the second physical condition on the basis of the presence of only one of: a) a droplet of the second fluid at the first location in the first fluidic channel; or b) or at least one of i) a droplet of the fourth fluid at the first location in the second fluidic channel, or ii) a droplet of the second fluid at the third location of the first channel.

38. The fluidic system of claim 24, further comprising an arrangement that provides for inversion logic, the arrangement comprising at least one of:

a first set of electrodes that traverses the at least a portion of the first fluidic channel, the first separation barrier, and the first toggle element; and a capacitor element; and a second set of electrodes which traverses the capacitor element and electrically couples with the first set of electrodes within the first separation barrier;

wherein voltage applied to the second set of electrodes is capacitively coupled with voltage applied to the first set of electrodes; wherein the toggle element toggles to the second physical condition or the first physical condition upon subjecting the toggle element to a voltage differential that is generated as a result of the first droplet being located at one of a first position or a second position in the first fluidic channel.

39. The fluidic system of claim 38, wherein the inversion logic device is configurable at least one of: a) selectively applying voltage a voltage potential to at least one of the first electrode system or the first capacitor element, b) selectively disabling at least one of the first capacitor element from providing the coupling of the third voltage potential, c) selectively disconnecting at least one of the first electrode system or the first capacitor element, or d) selectively not applying at least one of the first voltage potential, second voltage potential, or third voltage potential.

40. The fluidic system of claim 24, further comprising an arrangement that provides a universal logic device that is configurable for executing any one or more of a plurality of logic functions, the universal logic device further comprising at least one of:

a second fluidic control channel containing a third fluid through which is transported at least a second droplet comprising a fourth fluid;

a first set of electrodes arranged for providing a first voltage potential that traverses the at least a portion of the first fluidic control channel, the first separation barrier, and the at least a portion of the actuator system; and a first capacitor element for capacitively coupling a third voltage potential into at least one of a) the actuator system or b) a first separation barrier located between the first fluidic control channel and the actuator system;

a second set of electrodes arranged for providing a second voltage potential that traverses the at least a portion of the second fluidic channel, the second separation barrier, and which is electrically coupled to the first set of electrodes; or a second capacitor element for capacitively coupling a fourth voltage potential into at least one of a) the actuator system or b) a second separation barrier located between the second fluidic control channel and the actuator system.

41. The fluidic system of claim 40, wherein the universal logic device is configurable for at least one of: a) selectively applying voltage a voltage potential to at least one of the first or the second electrode systems or the first or second capacitor elements, b) selectively disabling at least one of the first or the second capacitor elements from providing the coupling of the third or the fourth voltage potentials respectively, c) selectively disconnecting at least one of the first or the second electrode systems or the first or the second capacitor elements, or d) selectively not applying at least one of the first voltage potential, second voltage potential, third voltage potential, or fourth voltage potential.

* * * * *